United States Patent [19]

Tupitsyn et al.

[11] 4,132,277

[45] Jan. 2, 1979

[54] PNEUMATIC REVERSIBLE IMPACT DEVICE FOR DRIVING HOLES IN SOIL

[76] Inventors: Konstantin K. Tupitsyn, Krasny prospekt, 51/3, kv. 25; Evgeny N. Cherednikov, Vokzalnaya Magistral, 5, kv. 329; Alexandr D. Kostylev, ulitsa Derzhavina, 19, kv. 44; Vladimir D. Plavskikh, ulitsa Gogolya, 233/1, kv. 34; Vladimir V. Klimashko, ulitsa Novogodnyaya, 44, kv. 24; Khaim B. Tkach, ulitsa Gogolya, 17, kv. 49; Andron T. Karavaev, ulitsa Pervomaiskaya, 118, kv. 19, all of Novosibirsk, U.S.S.R.

[21] Appl. No.: 838,733

[22] Filed: Oct. 3, 1977

[51] Int. Cl.[2] ..... E21B 11/02

[52] U.S. Cl. ..... 175/19; 173/91

[58] Field of Search ..... 175/19; 173/91

[56] References Cited

U.S. PATENT DOCUMENTS

| | | | |
|---|---|---|---|
| 3,727,701 | 4/1973 | Sudnishnikov et al. | 173/91 |
| 3,756,328 | 9/1973 | Sudnishnikov et al. | 175/19 X |
| 3,952,813 | 4/1976 | Chepurnol et al. | 175/19 X |

FOREIGN PATENT DOCUMENTS

| | | | |
|---|---|---|---|
| 2105257 | 9/1972 | Fed. Rep. of Germany | 175/19 |

*Primary Examiner*—Ernest R. Purser
*Assistant Examiner*—Richard E. Favreau
*Attorney, Agent, or Firm*—Lackenbach, Lilling & Siegel

[57] ABSTRACT

The device comprises a hollow cylindrical body, pointed front at its end which device accommodates a striker forming the front working chamber in said body, and has a cylindrical space at its rear end. Said space receives an air-distributing and reversing mechanism, thus forming the rear working chamber. The air-distributing and reversing mechanism has a bushing which is fixed relative to the body, and an axially movable bushing, both bushings being arranged coaxially, spring-loaded in the axial direction relative to each other, and forming a chamber located in the front part of said mechanism, with the chamber communicating with a source of compressed air and intended to move the movable bushing during reversal of the device. The side wall of the movable bushing has a through hole and a longitudinal external recess, both made in such a manner that during the forward travel of the device the through hole places the chamber formed by the bushings in communication with the source of compressed air while during the backward travel the through hole is covered by the fixed bushing and the chamber formed by the bushings communicates with the atmosphere through the external longitudinal recess.

1 Claim, 3 Drawing Figures

PNEUMATIC REVERSIBLE IMPACT DEVICE FOR DRIVING HOLES IN SOIL

The present invention relates to construction engineering and, in addition to making holes in soil during trenchless laying of underground mains, it can also be utilized for driving metal pipes into soil, gassing moulded-in-place pipes, etc.

Known in the prior art are reversible impact devices of the same type or application (U.S. Pat. No. 3,744,576); Patent of Federal Republic of Germany (publication No. P. 2105257) comprising a hollow cylindrical body pointed in front (in the direction of the hole) which has a striker mounted inside with a provision for reciprocating and striking blows in the direction of the front or rear ends of the body. The striker together with the body forms a front working chamber and has at the tail portion a cylindrical space which is open at the end, with said space receiving an air-distributing and reversing mechanism, thus forming the rear working chamber of the device. Said mechanism comprises a bushing installed immovably relative to the body, a movable bushing, and a calibrated spring which interacts with the bushings and moves the movable bushing on a drop of pressure of the compressed air delivered into the device. Both the fixed and movable bushings are of the same diameter and, are assembled together with the walls of the striker to form a chamber which is in constant communication with the source of compressed air; and said chamber together with the spring serves to move the movable bushing to the foremost or rearmost positions which reverses the direction of the striker blows and, eventually, changes the direction of progressive movement of the device as a whole. The movable bushing is displaced by changing the pressure of air delivered into the device.

The disadvantages of the prior art device include a complicated design which reduces operational reliability, and uncontrollable reversing of the device involving an accidental change of pressure of air delivered into the device.

Known in the prior art are similar devices (Pat. Nos. 2356804, 2157259, Federal Republic of Germany) which differ from those described in that their air-distributing and reversing mechanism comprises a stepped branch pipe installed in the body with a provision for turning around its axis and for moving axially, wherein said branch pipe are made of bushings rigidly interconnected with each other. Besides, the air-distributing and reversing mechanism of this device comprises a system of retainers which keep the stepped branch pipe from undesired axial turning and axial movement during operation of the device, and it also comprises a rope connected to the retainer which checks the turning of the stepped branch pipe. The rope is intended to release the stepped branch pipe, therefore it is located, together with the air-supply hose, in the hole and it always comes out on the ground surface.

The travel of the device is reversed by moving the entire stepped branch pipe relative to the body of the device and setting it in a new fixed position. For this purpose the device has to be stopped by cutting off the compressed air supply, by tensioning the rope and simultaneously turning the stepped branch pipe through 180° around its axis, and transmitting the torque through the hole. Then the stepped branch pipe must be moved to the rearmost position by the hose and locked in this position by turning it in the opposite direction through 180°.

The disadvantages of these devices are that they cannot be reversed from the backward to the forward travel when the device is inside the hole and the hose cannot be turned when the hole is driven through loose soils where the hole does not stay as it is but caves in following the progress of the device. In such cases, the hose gets squeezed by the fallen soil and cannot be turned around its axis for reversing the device.

A common disadvantage of the above-described devices is breaking of the hose squeezed in the hole. Frequently this results in the loss of the entire device in the soil.

There also are other prior art devices of a similar type or application (see, for example, Pat. No. 1175161 Federal Republic of Germany and U.S. Pat. No. 3,474,873, U.S.A.). The movement of these devices is also reversed by changing the pressure of compressed air delivered to the device. Their disadvantage also lies in an uncontrollable reversal on accidental changes in the pressure of compressed air entering the device.

Besides, these devices are based on a different layout so that their air-distributing and reversing mechanisms differ radically from those described above. They have additional control valves and an additional system of channels for the backward travel of the device which complicates their design and makes them unreliable in service.

An object of the present invention resides in providing a pneumatic reversible impact device for driving holes in soil which is relatively simple in design and reliable in operation.

Thus, according to the present invention, the pneumatic reversible impact device for driving holes in soil precludes any uncontrollable reversing where an accidental change in the pressure of compressed air enters the device, and rules out breaking of the hose if it gets squeezed in the hole because the device moving ahead with the squeezed hose tensions the latter; this leads to automatic reversing and, consequently, to slackening of the hose. Automatic reversing rules out breaking of the hose and warns the operator who has to take the necessary measures to bring the critical situation under control.

Now the invention will be described in detail by way of example with reference to the accompanying drawings, in which.

Figure 1:
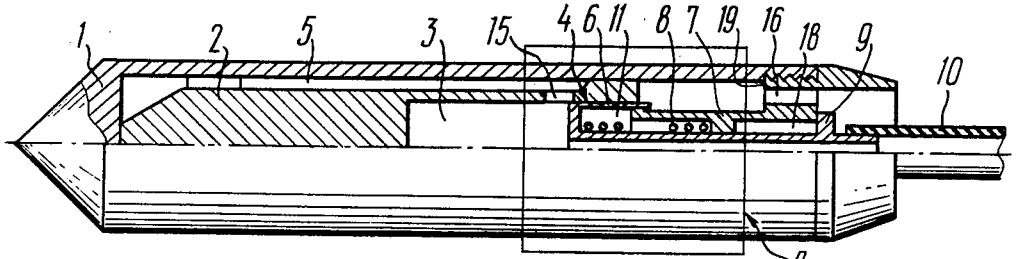
FIG. 1 is a longitudinal sectional view of the pneumatic reversible impact device for driving holes in soil.
Figure 2:
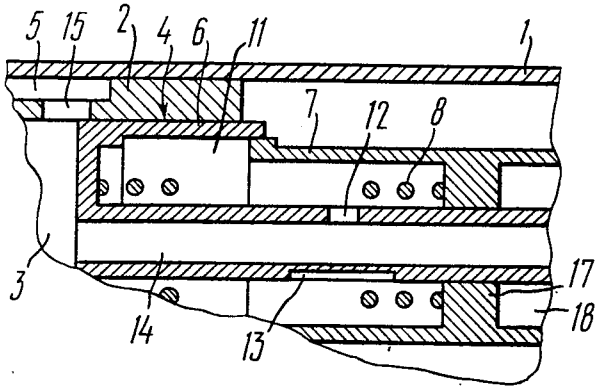
FIG. 2 shows an enlarged fragmentary view identified by the letter "A" in FIG. 1, enlarged, illustrating the air-distributing and reversing mechanism on the forward travel.
Figure 3:
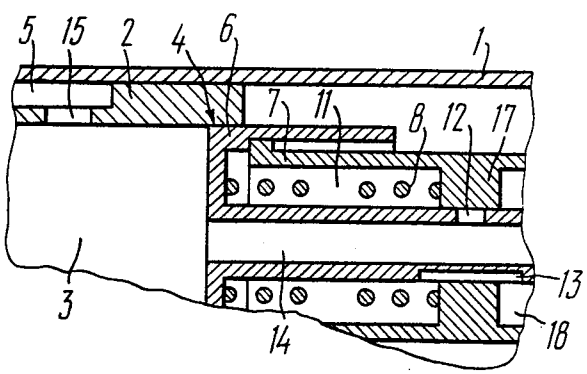
FIG. 3 illustrates another enlarged fragmentary view of the pneumatic reversible impact device, but showing same during the backward travel of the device.

The device illustrated in FIGS. 1-3 comprises a hollow cylindrical body 1 pointed in front (as the hole goes) which accommodates a striker 2 mounted with a provision for reciprocating and striking blows in the direction of the front or rear ends of the body; and at the rear end the striker has a cylindrical space 3. The front end of the air-distributing and reversing mechanism 4 enters the space 3 thus forming the rear working chamber 3 of the device.

The internal surface of the body 1 and the external surface of the striker 2 form the front working chamber 5 of the device.

The air-distributing and reversing mechanism 4 of the device comprises an axially-movable stepped bushing 6 and a fixed bushing 7 rigidly connected with the body 1. Installed between the bushings 6 and 7 is a precompressed spring 8 which loads said bushings in the axial direction. The tail portion of the movable bushing 6 is provided with a shoulder 9 which restricts its forward movement (to the left in FIGS. 1-3). The hose 10 for supplying compressed air is connected to the rear end of the movable bushing 6.

The movable and fixed bushings 6 and 7 are made in such a manner that their front parts form a chamber 11 which, being filled with compressed air, holds the movable bushing 6 in the foremost (left) position. The movable bushing 6 in the side wall of less diameter has through holes 12 for admitting compressed air into the chamber 11, and a longitudinal external recess (channels) 13 for releasing the air from the chamber 11 into the atmosphere.

When the device is at rest and contains no compressed air, the movable bushing 6 occupies the position shown in FIG. 2, i.e. the foremost position. The precompressed spring 8 moves the movable bushing 6 forward until its shoulder 9 comes to bear against the fixed bushing 7.

The device functions as follows. The compressed air is delivered from a source (not shown) through the hose 10 and the central channel 14 of the movable bushing 6 into the rear working chamber 3 and thence, through the channel 15 of the striker 2, into the front working chamber 5. Besides, the compressed air flows from the central channel 14 and along the through holes 12 of the movable bushing 6 into the chamber 11. Meanwhile, the movable bushing 6 maintains its foremost position as shown in FIG. 2 because the force of the air pressure from the side of the chamber 3 is weaker than the total force of the precompressed spring 8 and the pressure of air from the side of the chamber 11.

Being actuated by compressed air, the striker 2 moves to the rear (to the right in FIG. 1) because at the same pressures of air in the working chambers 3 and 5 the force applied to the striker from the side of the chamber 5 is stronger than that acting from the chamber 3 because the working area of the striker 2 is larger from the side of the chamber 5 than it is from the side of the chamber 3. As the channel 15 of the striker 2 is closed by the external surface of the movable bushing 6 and the supply of air into the chamber 5 ceases, the striker will continue moving backward under the force of the expanding air in the front working chamber 5. During further rearward movement of the striker 2, its channel 15 is uncovered by the external surface of the movable bushing 6 and the air flows from the chamber 5 through the channel 15 of the striker 2 and through the channel 16 of the fixed bushing 7 into the atmosphere. The striker stops under the effect of the force originated by the pressure of air in the rear working chamber 3, then it makes its forward stroke and deals a blow to the body 1 which corresponds to the position of the striker as shown in FIGS. 1 through 3. Then the working cycle is repeated over again.

Due to the blows delivered and impacted on the body, the device 1 moves through the soil, and compacts it thus making a hole. This corresponds to the forward travel of the device.

The movement of the body under the effect of the reaction forces occasioned during the reciprocating motion of the striker 2 is countered by the forces of friction between the external surface of the body 1 and the soil.

When making a vertical (blind) hole and encountering an insurmountable obstacle (e.g. a large boulder) or in case of heavy curving of the hole, the device has to be reversed.

To reverse the device moving forward, it is necessary to pull momentarily at the hose 10 with a force determined by the stiffness of the spring 8. Under the effect of this force the movable bushing 6 connected with the hose 10 moves to the rearmost position (FIG. 3). The holes 12 of the movable bushing 6 are covered by the inner shoulder 17 of the fixed bushing 7, thus preventing the access of compressed air to the chamber 11 while the longitudinal recesses 13 places the chamber 11 in communication with the atmosphere through the space 18. After the air has escaped from the chamber 11 the movable bushing 6 is locked in the extreme right position by the pressure of air in the chamber 3 which is higher than the force of precompression of the spring 8.

The movement of the movable bushing 6 to the extreme right position results in an earlier admission of air into the front working chamber 5 and in a retarded discharge of air from this chamber so that the striker 2 on its forward travel is braked by the compressed air in the chamber 5 and does not strike the body 1. When the striker moves to the rear (to the right), the delay of air discharge from the front chamber 5 causes the striker 2 to deal blows to the face 19 of the fixed bushing 7 which is rigidly connected with the body 1. Under the force of these blows the device moves backward and comes out of the hole. Withdrawal of the device from the hole corresponds to its backward travel.

In order to switch the device again to forward travel, it is necessary to shut off the compressed air supply. When there is no compressed air in the chambers 3 and 11 of the device, its movable bushing 6 acted upon by the precompressed spring 8 moves forward until its shoulder 9 comes to bear against the fixed bushing 7. Therefore, when the device is at rest, the relative positions of its parts correspond to the forward travel. Thus, to start the device forward again after the stoppage of the air supply, the compressed air must be fed into the device without tensioning the hose 10.

Thus, reversals of the device are accomplished by starting and stopping the air supply and by tensioning the hose which rules out uncontrollable reversals in case of accidental changes in the air pressure.

Another important merit of the device according to the invention is its automatic reversal when the hose is squeezed in the hole. In the prior art devices squeezing of the hose in the hole led to breaking of the hose and loss of the entire device in the soil.

We claim:

1. A pneumatic reversible impact device for driving holes in soil by compacting the latter comprising: a hollow cylindrical body pointed in front; a striker accommodated in said body with axial reciprocating motion for striking blows in the direction of the front and rear ends of the body, said striker forming, together with said body, the front working chamber and having a cylindrical space at the rear end; a mechanism for distributing air and reversing the device, located in the rear space of said striker and forming, together with the latter, the rear working chamber of the device; said air-distributing and reversing mechanism having a bushing which is fixed relative to said body of the device, and an axially-movable stepped bushing, both bushings being arranged coaxially, and being spring-loaded relative to each other in the axial direction and forming a chamber located in the front part of said air-distributing and reversing mechanism; said chamber communicating with a source of compressed air during the forward travel of the device and serving for moving said movable bushing when the device is reversed; said movable bushing has a through hole in the side wall and an external longitudinal recess, so that during the forward travel of said device the through hole places said chamber formed by said bushings in communication with the source of compressed air while during the backward travel of the device the through hole of said movable bushing is covered by said fixed bushing and said chamber formed by said bushings communicates with the atmosphere through said external longitudinal recess of said movable bushing.

* * * * *